United States Patent [19]

Karlsen

[11] 4,260,152

[45] Apr. 7, 1981

[54] GAME

[75] Inventor: Kurt B. Karlsen, Etobicoke, Canada

[73] Assignee: Finn Jensen, Montreal, Canada

[21] Appl. No.: 56,142

[22] Filed: Jul. 9, 1979

[30] Foreign Application Priority Data

Jun. 18, 1979 [CA] Canada ..... 330035

[51] Int. Cl.[3] ..... A63F 7/20; A63F 7/24

[52] U.S. Cl. ..... 273/85 D; 124/4; 273/322

[58] Field of Search ..... 273/85 C, 85 D, 322; 124/4, 5, 6

[56] References Cited

U.S. PATENT DOCUMENTS

| | | | |
|---|---|---|---|
| 2,505,090 | 4/1950 | Berry | 273/322 |
| 3,416,799 | 12/1968 | Sande Lopez | 273/85 D |
| 3,537,707 | 11/1970 | Goldberg | 124/4 X |
| 3,781,010 | 12/1973 | Matsumoto | 273/85 C |

FOREIGN PATENT DOCUMENTS

| | | | |
|---|---|---|---|
| 512569 | 7/1952 | Belgium | 273/85 C |
| 827303 | 8/1952 | Fed. Rep. of Germany | 273/85 D |
| 1085943 | 8/1954 | France | 273/85 D |
| 505467 | 12/1954 | Italy | 273/85 D |
| 17117 | of 1908 | United Kingdom | 273/322 |
| 699567 | 11/1953 | United Kingdom | 273/85 D |

*Primary Examiner*—Paul E. Shapiro

*Attorney, Agent, or Firm*—Balogh, Osann, Kramer, Dvorak, Genova & Traub

[57] ABSTRACT

A game having axially movable and rotatable pull rods which carry individual ball control devices which can be used to pick up a ball and project it toward a target. Each ball control device has two opposite scoops which are used to pick a game ball up and to project the ball toward a target. A trackway extends between the scoops so that the game ball can be transferred from one scoop to the other enabling projection of the ball toward either end of the game as desired by a player.

14 Claims, 8 Drawing Figures

GAME

The present invention relates to a game and to a table game to be played by two or more people in direct competition.

The game employs a projectile in the form of a ball of rubber or other suitable material, and the ball is projected or "shot" by ball control devices which are manipulated by the players. The game is primarily directed to the playing of the game of basketball, but it will be apparent that the concept is also readily adaptable to the playing of other games such as hand ball and the like.

In preferred construction, and assuming that two people are playing the game, each player controls two elongate rods which are movable both axially and rotatably and the rods carry ball control devices which upon manipulation of the rods can pick the ball up from the bottom surface of the game and project the balls toward respective targets placed at opposite ends of the structure. The essential feature of the present invention lies in the construction of the ball control devices and the arrangement is such that each ball control device has two opposed ball pick-up and projecting scoops and after pick up the ball can, as desired, be transferred to the opposed scoop so that the game ball may be projected toward a target to effect a score.

DESCRIPTION OF PRIOR ART

Noel C. Barbot et al in U.S. Pat. No. 2,282,846 granted May 12, 1942, and entitled "Game Apparatus" describes an assembly having axially movable and rotatable rods which carry scoop members to pick-up a ball from the bottom of the apparatus by manipulation of a rod by a player and a quick twisting movement of the rod results in the propelling of the ball toward a target at one end of the assembly. With the arrangement of this U.S. Patent, however, the ball once picked up by a scoop member can be propelled only in one direction and no provision is made to enable a player after he has picked up the ball to project the ball to either end of the game depending upon the end toward which that particular player is attempting to score.

OBJECTS OF THE PRESENT INVENTION

The primary object of the present invention is to provide a game apparatus which can be played by two or more competitors in direct competition and which enables the players by suitable manipulation of control rods to control projection of a game ball toward either end of the assembly as desired, and dependent upon the direction in which that particular player is attempting to score. This capability of being able to project the game ball in either direction is achieved by providing each ball control device with opposed ball pick up and projecting scoops with a trackway extending between each of the scoops so that the ball picked up by one of the scoops can be transferred by way of the trackway to the opposite scoop so that the game ball can be projected in a direction opposed to the direction from which the pick up is made. Depending, of course, upon the direction of pick up the ball can be held in the scoop making the pick up and projected upwardly in an arc in the same direction as the original movement of the ball.

A further object of the present invention is to specifically provide a game having a bottom surface and upstanding side and end walls providing a playing area and a target provided at each end, and an equal number of spaced parallel control rods extending through the side walls and transversely across the playing area, the control rods being axially movable and rotatable, manipulation of half of the rods being by a player on one side of the game and manipulation of the remaining rods being by a person on the opposite side, the control rods being parallel with the bottom surface and each control rod carrying at least one ball control device for picking a game ball from the bottom surface and projecting the ball toward a target upon manipulation of the respective control arm, each ball control device comprising two opposed ball scoops and a trackway extending therebetween whereby upon rotation of the rod, a game ball can be transferred from one scoop to the other enabling projection of the ball toward one or other of the targets as desired, the scoops of the devices during rotation defining an arc of movement which is generally tangential to an adjacent portion of the bottom surface.

BRIEF DESCRIPTION OF ACCOMPANYING DRAWINGS

DETAILED DESCRIPTION OF ACCOMPANYING DRAWINGS

Figure 1:
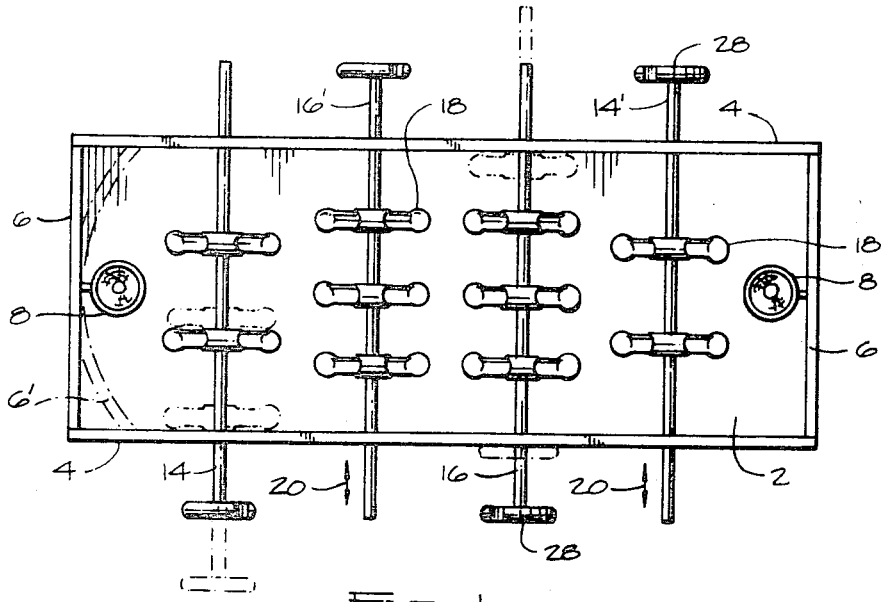
FIG. 1 illustrates in top view the game assembly according to the present invention.

The accompanying drawings will now be described in detail and wherein like reference numerals are used to indicate like component parts.

Figure 2:
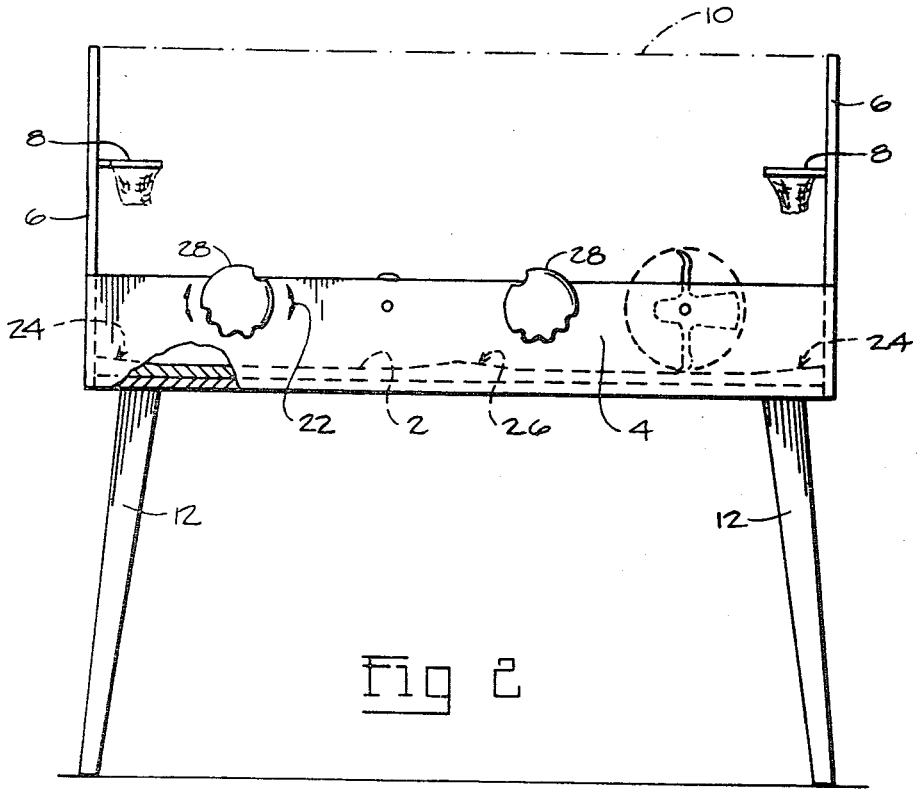
FIG. 2 illustrates in side partially sectioned view the apparatus as shown in FIG. 1.

The game assembly consists of a generally rectangular playing area having a bottom 2, side walls 4, and end walls 6. As shown in FIG. 2, the end walls 6 project upwardly and each end wall carries a target 8 which in FIGS. 1 and 2 are shown as being miniature basketball hoops and nets. In the specific game as illustrated in FIGS. 1 and 2, the object of the game is for the players to project a game ball through the hoops to score points. It will be appreciated, however, that the target 8 provided at each end of the assembly could be of varying design and configuration. The end walls 6 may be opaque or made of transparent material such as glass or plastic, and the playing area can, if desired, be completely enclosed by transparent top and side coverings shown generally by broken line 10 in FIG. 2.

FIG. 2 illustrates the game assembly as being supported on legs 12 but it will be appreciated that these legs can be omitted, and the game placed directly on a table.

The players sit on opposite sides of the apparatus and in the embodiment shown in FIGS. 1 and 2, each player controls rods which extend through the side walls 4 and these rods are both rotatable and axially movable with respect to the side walls. One player controls rods 14 and 16, while the other player sitting on the opposite side of the game controls rods 14' and 16'. In the specific construction shown in FIGS. 1 and 2, rods 14 and 14' carry two ball control devices 18, and rods 16 and 16' carry three ball control devices but these numbers are not limiting nor are the number of rods. The devices 18 carried by rods 14 and 14' can be considered as being "guards" as in the game of basketball, whereas the devices 18 carried by rods 16 and 16' are the "forwards". With this arrangement, the devices 18 manipulated by the player controlling rods 14 and 16, will project a game ball (not shown in FIGS. 1 and 2) towards the target hoop 18 at the right-hand end of the game as shown in FIGS. 1 and 2, while the devices controlled by the second player who manipulates rods 14' and 16' will project the ball toward the target hoop positioned at the left hand end as shown in FIGS. 1 and 2. The guards 18 can themselves propel the ball directly toward the target hoop at the other end of the game or they can move the ball forwardly to the "forward" positions enabling a shorter projection toward the target.

As indicated above, the rods 14, 14' 16, 16' are transversely movable in the direction shown by the double-ended arrows 20; and in broken lines in FIG. 1 the extreme lateral movements of these rods is shown. The rods are also rotatable as shown by double-ended arrows 22 in FIG. 2. It will be appreciated then that any device picking up a ball can be moved to a position directly between the target hoops to simplify aiming towards the targets. Alternatively, the ball can be projected from any off-center position enabling the banking of shots off the end walls to score a basket. In this connection, the end walls may be straight as shown in solid lines in FIGS. 1 and 2, or may be curved or angled to facilitate the banking of a ball off the wall to score a basket and such a curving arrangement of the end walls is shown in broken lines in FIG. 1, by numeral 6'.

In order that the ball at all times will keep moving and hence always be in play, the upper surface of the bottom 2 may be provided with an undulated surface such as shown in FIG. 2 wherein the ends of the bottom slope upwardly as shown at 24, and a central raised and rounded portion 26 may be provided.

Play may be started by placing a game ball in a scoop of a ball control device 18, and the player controlling this particular device then with a quick movement of his hand or handle 26 projects the ball in an arc towards the goal to which he is shooting. If a goal is scored, the shooting player receives a selected number of points such as one or two, but whether or not the competitor is successful in making a goal play continues, and it is the object of each player to scoop or pick up the ball and direct it toward the goal toward which he is shooting.

The arrangement whereby a ball control device can pick up a ball and project the ball toward either end of the court is an essential feature of the present apparatus and such devices will be described in detail particularly with respect to FIGS. 3 through 7.

Figure 3:
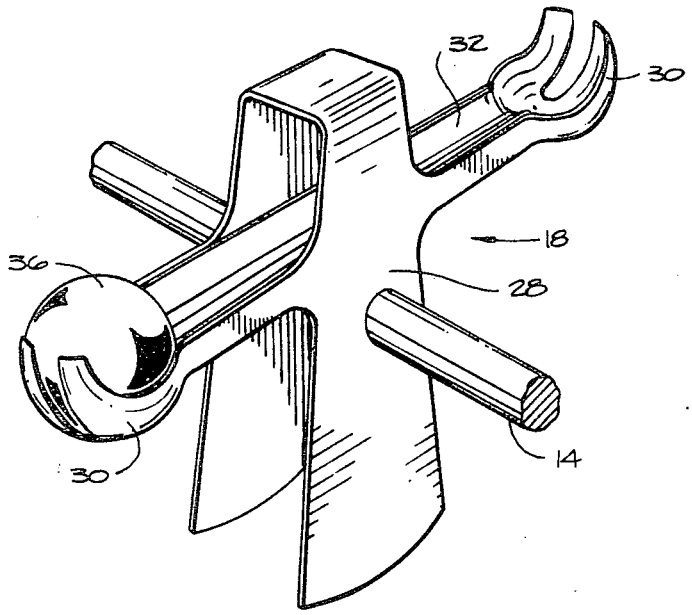
FIG. 3 illustrates in enlarged perspective view one embodiment of a ball control device.
Figure 4:
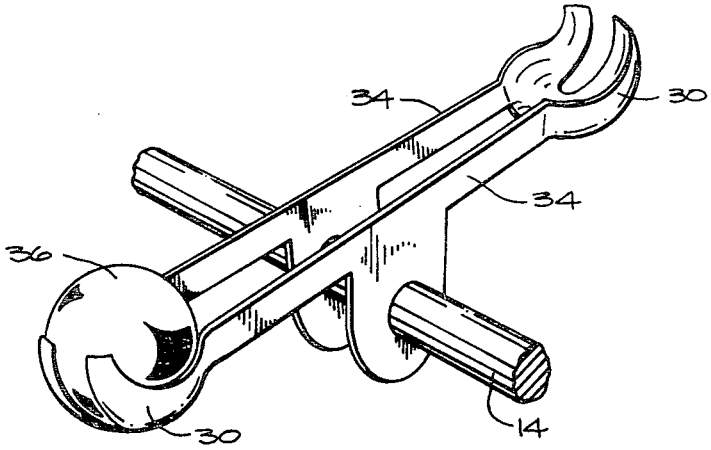
FIG. 4 illustrates in enlarged perspective view a further embodiment of a ball control device.
Figure 5:
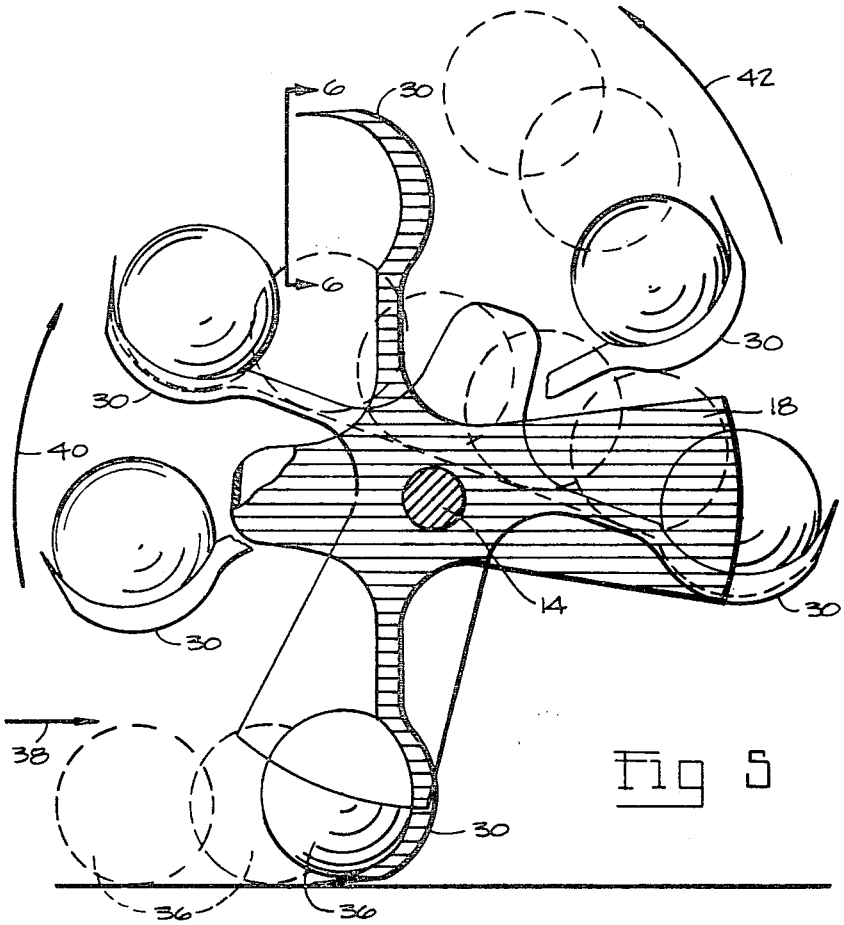
FIG. 5 illustrates in enlarged side view the ball control device shown in FIG. 3 in various rotated positions, and which device enables a ball to be scooped from the bottom of the apparatus and then projected toward one or other ends of the assembly according to the specific direction in which that particular player is shooting.
Figure 6:
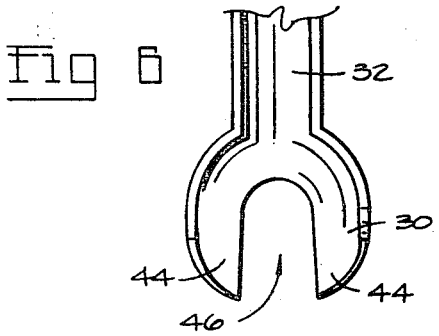
FIG. 6 is an enlarged view of one scoop member taken along line 6—6 of FIG. 5.
Figure 7:
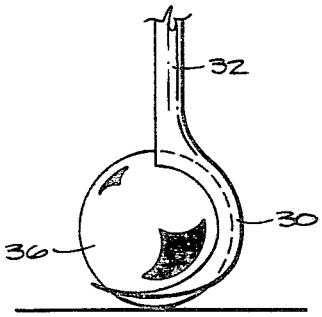
FIG. 7 is a side view of a scoop member in position with respect to the bottom surface of the game to pick up a game ball.

FIGS. 3 and 4 illustrate in solid lines two embodiments of a ball control device 18. The device is securely positioned on a control rod which in this case is numbered 14, and rotation of the control rod will cause the figure to follow a rotating movement such as shown in FIG. 5, and as shown to the right in FIG. 2.

The device shown in FIG. 3 has a central portion 28 and if desired the representations of a basketball player or other athlete may be provided thereon for realism. The device has two opposed scoops 30 either of which can be used to pick a game ball up depending upon the direction of movement of the ball. A trackway extends between the scoops 30 and in FIG. 3 the trackway is in the form of a shallow groove 32 while FIG. 4 shows the trackway as consisting simply of spaced and parallel rails 34.

A game ball 36 is shown as being carried by one of the scoops.

Movement of the ball control devices will now be described with reference to FIG. 5 which shows in side view a ball control device as shown in FIG. 3. As shown in FIG. 5, a ball 36 shown in broken lines is approaching the scoop 30 from the left in the direction of arrow 38 and the scoop is then positioned to be in the path of movement of the ball so that the ball will roll into the scoop and occupy the position as shown in full lines at the bottom of the drawing. The control rod 14 and device 18 are then rotated clockwise in the direction of arrow 40 to elevate the ball to the positions as shown to the left in FIG. 5. If it is desired to project the ball upwardly and to the right as shown in FIG. 5, a simple clockwise twist of the control rod 14 will result in projecting of the ball in a looping arc towards the right. However, if the player desires to project the ball towards the left in a looping arc as shown by arrow 42, the ball 36 is transferred from the position as shown in the left in FIG. 5 to the opposed scoop shown to the right and this transfer is made possible by the provision of trackway 32 extending between the opposed scoops 30 so that the ball 36 can be simply and quickly transferred from the position shown at the left in FIG. 5 to the position shown at the right. When the ball is in the right hand position the player simply twists his wrist in a counterclockwise direction to project the ball 36 in a looping arc as shown by full arrow 42 and toward the target goal to which he is shooting.

It will be seen that rotation of the rods results in the scoops describing an arc which is generally tangential to the surface of the bottom 2 and this circular tangential movement is shown in FIGS. 2 and 4, and the close movement of the scoops with respect to the bottom surface facilitates ball pick up.

In preferred construction, the scoops 30 are of generally semi-circular shape having a radius equal to or a little larger than the radius of the ball which is used. Also in preferred construction, the scoops are formed with two spaced fingers 44 separated by a generally U-shaped opening 46 (see particularly FIG. 6) which extends into the scoop a distance past the center thereof, so that the ball 36 is still supported by its contact with the bottom 2 of the game while being partically encircled by the fingers 44 (see FIG. 7). This arrangement guards against the ball being jarred out of the scoop during pick-up as a result of contact between the ball and the back of the scoop and any tendency of the ball to move backwardly out of the pocket is minimized.

The game ball 36 may be of any suitable material such as rubber or plastic. Advantageously for playing the game of basketball the ball may be of low bounce plastic material which may be made by blow molding and weight approximately 5 grams. For playing a game simulating handball the game ball is preferably slightly heavier and of low bounce rubber or plastic.

Figure 8:
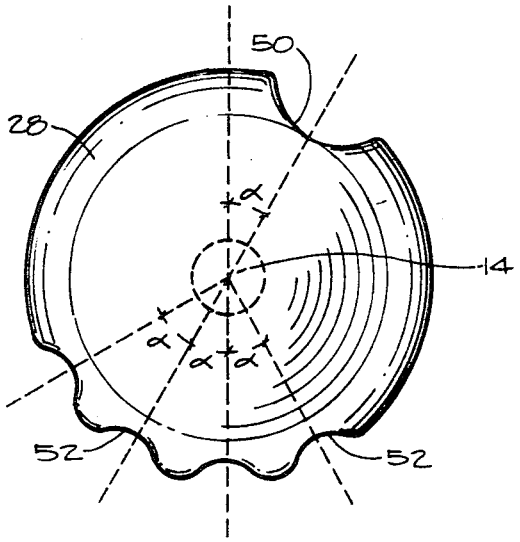
FIG. 8 is an enlarged view showing a preferred shape of handle.

A preferred shape of handle 26 is shown in enlarged view in FIG. 8. To facilitate projecting a game ball by wrist movement the handle is in the form of a generally circular disc having thumb 50 and finger 52 notches, with the thumb notch being in the upper portion of the disc and the finger notches 52 being in the lower portion. Preferably, the center of thumb notch 50 is offset an angle $\alpha$ with respect to the vertical and angle $\alpha$ may suitably be 30°. The centers of the finger notches 54 may also be suitably offset by an angle $\alpha$ which may also be 30°.

The handles may be of any suitable size, and the diameter of the disc may be in the order of $2\frac{3}{4}$ inches, with the radius of the thumb notch 50 being about $7/16$–$\frac{1}{2}$ inches and the radii of the finger notches being about $\frac{1}{4}$ inches.

The foregoing description and accompanying drawings show a game arrangement to be played by competing players, and having a target at each end of the game board. It is also contemplated, however, that a game of skill and dexterity utilizing the present concepts can be provided for use by only a single player, and wherein a target goal is provided at one end of the structure. In this suggested arrangement which is not specifically illustrated only one control rod 14 will be provided, and it will carry only one ball control device 18. With this arrangement, the person playing the game will be able to pick up a game ball utilizing the present ball control device, and then project it towards the target. With such an arrangement, two or more people could play the game by taking alternate shots towards the goal.

I claim:

1. A game having a bottom surface and upstanding side and end walls providing a playing area and a target provided at each end, and an equal number of spaced parallel control rods extending through the side walls and transversely across the playing area, the control rods being axially movable and rotatable, manipulation of half of the rods being by a player on one side of the game and manipulation of the remaining rods being by a person on the opposite side, the control rods being parallel with the bottom surface and each control rod carrying at least one ball control device for picking up a game ball from the bottom surface and projecting the ball toward a target upon manipulation of the respective control arm, each ball control device comprising two opposed ball scoops and a trackway extending therebetween whereby upon rotation of the rod, a game ball can be transferred from one scoop to the other enabling projection of the ball towards one or other of the targets as desired, the scoops of the devices during rotation defining an arc of movement which is generally tangential to an adjacent portion of the bottom surface.

2. Game assembly according to claim 1, wherein the end walls extend upwardly above the side walls and a target in the form of a miniature basketball hoop is provided upwardly on the inner surface of each end walls.

3. Game assembly according to claim 2, wherein the end walls are transparent and the playing area is closed by transparent top and side panels.

4. Game assembly according to claim 1, having four control rods, the control rods closest the end walls carrying two ball control devices each and the central two control rods carrying three ball control devices each.

5. Game apparatus according to claim 1, including a handle provided on one end of each control rod exteriorly of the side walls.

6. Game apparatus according to claim 5, wherein the handles are in the form of generally circular discs to which the rods are axially secured, the circumference of the discs being notches to receive the thumb and fingers of a person playing the game.

7. Game apparatus according to claim 6, wherein in position of a rod with the trackway being generally horizontal the notch for the thumb is in the upper portion of the disc and the notches for the fingers being in the lower portion.

8. Game apparatus according to claim 7, wherein the center of the notch for the thumb is offset approximately 30° from vertical, and the centers of four notches for the fingers being offset approximately 30° from each other.

9. Game apparatus according to claim 1, wherein the bottom surface slopes upwardly adjacent the end walls and a raised rounded portion extends between side walls at a position centrally between the end walls.

10. Game apparatus according to claim 1, wherein the trackway is a concave groove, and the scoops are of generally semi-circular configuration having extended fingers separated by a V-shaped slot facilitating entry of a game ball into the scoop.

11. Game apparatus according to claim 1, wherein the trackway extending between scoops consists of spaced and parallel rails.

12. Game apparatus according to claim 1, wherein the game ball is of rubber or plastic material.

13. Game apparatus according to claim 1, wherein the ball is of low bounce plastic material having a weight of about 5 grams.

14. In a game of the type having a generally horizontal bottom playing surface and wherein a ball is projected towards a target, a rotatably mounted ball control device comprising two opposed ball scoops and a trackway extending between the scoops, whereby upon partial rotation of the device, a game ball can be transferred from one scoop to the other enabling projection of the ball toward the target, the scoops of the device during rotation defining an arc of movement which is substantially tangential to an adjacent portion of the bottom playing surface.

* * * * *